US005614346A

United States Patent [19]

Adel et al.

[11] Patent Number: 5,614,346

[45] Date of Patent: Mar. 25, 1997

[54] METAL OXIDE- AND METAL-COATED CARRIERS FOR ELECTROPHOTOGRAPHY

[75] Inventors: Jörg Adel, Ludwigshafen; Rainer Dyllick-Brenzinger, Weinheim, both of Germany

[73] Assignee: BASF Aktiengesellschaft, Ludwigshafen, Germany

[21] Appl. No.: 381,568

[22] Filed: Jan. 31, 1995

[30] Foreign Application Priority Data

Feb. 7, 1994 [DE] Germany ..... 44 03 678.5

[51] Int. Cl.[6] ..... G03G 9/107; G03G 9/113

[52] U.S. Cl. ..... 430/106.6; 430/108; 430/137; 428/404; 428/405; 427/127

[58] Field of Search ..... 430/106.6, 108, 430/137; 428/404, 405; 427/127

[56] References Cited

U.S. PATENT DOCUMENTS

| | | | |
|---|---|---|---|
| 3,632,512 | 1/1972 | Miller . | |
| 3,736,257 | 5/1973 | Miller . | |
| 3,841,901 | 10/1974 | Novinski et al. | 428/404 |
| 4,093,459 | 6/1978 | Westdale . | |
| 4,925,762 | 5/1990 | Ostertag et al. . | |

FOREIGN PATENT DOCUMENTS

| | | | |
|---|---|---|---|
| 0205123 | 12/1986 | European Pat. Off. . | |
| 0303918 | 2/1989 | European Pat. Off. . | |
| 609897 | 8/1994 | European Pat. Off. | 430/106.6 |
| 2007005 | 10/1970 | Germany . | |
| 4140900 | 6/1993 | Germany . | |
| 1303267 | 1/1973 | United Kingdom . | |
| 1448381 | 9/1976 | United Kingdom . | |
| WO93/12470 | 6/1993 | WIPO . | |

OTHER PUBLICATIONS

English–Language Abstract of JP–A–60–227266 pub. Nov. 12, 1985.

English–Language Abstract of JP–A–63–237066 pub. Oct. 3, 1988.

*Primary Examiner*—Janis L. Dote

*Attorney, Agent, or Firm*—Oblon, Spivak, McClelland, Maier & Neustadt, P.C.

[57] ABSTRACT

Carriers for electrophotography, based on magnetic cores coated with metal oxide and with metal or magnetite, and their preparation and their use for electrophotographic two-component developers.

11 Claims, No Drawings

METAL OXIDE- AND METAL-COATED CARRIERS FOR ELECTROPHOTOGRAPHY

The present invention relates to novel carriers for electrophotography, based on magnetic cores coated with metal oxide and with metal or magnetite.

The present invention furthermore relates to novel carriers coated with molybdenum and/or tungsten.

The present invention also relates to the preparation of these carriers and to their use for the preparation of electrophotographic two-component developers.

Two-component developers are used in electrophotographic copiers and laser printers for developing an electrophotographically produced, latent image and usually consist of carrier particles and toner particles. The carrier particles are magnetizable particles having a size of, as a rule, from 20 to 1000 μm. The toner particles consist essentially of a color-imparting component and binder and are from about 5 to 30 μm in size.

In the copying process, the electrostatic, latent image is produced by selective exposure of an electrostatically charged photoconductor drum to light reflected from the original. In the laser printer, this is effected by means of a laser beam.

In order to develop the electrostatic image, toner particles are transported by means of a magnetic brush, ie. carrier particles aligned along the field lines of a sectored magnet, to the photoconductor drum. The toner particles adhere electrostatically to the carrier particles and acquire an electrostatic charge opposite to that of the carrier particles as a result of friction during transport in the magnetic field. The toner particles thus transferred by the magnetic brush to the photoconductor drum give a toner image, which is subsequently transferred to electrostatically charged paper and fixed.

The carrier particles used have to meet a number of requirements: they should be magnetizable and thus permit a rapid build-up of the magnetic brush.

Furthermore, their surface should have a conductivity which on the one hand is sufficiently low to prevent a short-circuit between sectored magnet and photoconductor drum but on the other hand should be sufficiently high to permit the build-up of a conductive magnetic brush and hence also sufficient solid area development in the finished image, particularly for fast-working systems, such as high-speed laser printers. Advantageous resistances for this purpose are as a rule from $10^3$ to $10^8$ ohm.

The conductivity should remain constant over long operating times of the carrier, in order to maintain the optimum working range of the magnetic brush.

Not least, the carrier particles should also be flowable and should not agglomerate in the developer storage vessel.

In order to meet these requirements, the carrier particles consisting of magnetic material must as a rule be coated.

EP-A-303 918 and DE-A-41 40 900 describe metal oxide-coated carriers which permit any desired charge build-up on the toner, including high positive charge build-up. However, depending on the thickness, required for sufficient charge build-up on the toner, of the particular metal oxide layer applied, these carriers frequently have conductivities which are too low (resistances usually of $>10^8$ ohm), in particular for high-speed systems.

U.S. Pat. Nos. 3,632,512 and 3,736,257 disclose metal-coated carriers which have extremely high conductivities but with which the desired charge-build up on the toner cannot be obtained.

It is an object of the present invention to provide carriers for electrophotography which have a satisfactory property profile.

We have found that this object is achieved by carriers for electrophotography which are based on magnetic cores coated with metal oxide and with metal or magnetite.

We have also found a process for the preparation of these carriers by gas-phase coating of agitated core particles, wherein the metal oxide layers are applied by hydrolysis of volatile metal alcoholates or metal halides or by oxidation of metal carbonyls or metal organyls and the metal layers are applied by inert gas-phase decomposition of metal carbonyls or metal organyls.

We have also found a process for the preparation of carriers having an inner molybdenum and/or tungsten layer and an outer molybdenum oxide and/or tungsten oxide layer, wherein the agitated core particles are first coated with a metal layer by inert gas-phase decomposition of molybdenum carbonyls or aryls and/or tungsten carbonyls or aryls, and said metal layer is then oxidized at the surface by heating in an oxidizing atmosphere.

We have also found carriers for electrophotography which are based on magnetic cores coated with molybdenum and/or tungsten, and a process for their preparation, wherein the agitated core particles are coated with molybdenum and/or tungsten by inert gas-phase decomposition of molybdenum carbonyls or aryls and/or tungsten carbonyls or aryls.

Not least, we have found the use of the stated carriers for the preparation of electrophotographic two-component developers.

The cores of the novel carriers may consist of the conventional magnetically soft materials, such as iron, steel, magnetite, ferrites (for example nickel/zinc, manganese/zinc and barium/zinc ferrites), cobalt and nickel, or of magnetically hard materials, such as $BaFe_{12}O_{19}$ or $SrFe_{12}O_{19}$ and may be present as spherical or irregularly shaped particles or in sponge form. Composite carriers, ie. particles of these metals or metal compounds embedded in polymer resin, are also suitable.

Preferred metal oxides for coating the novel carriers with metal oxide are those which can be deposited from the gas phase on the substrate to be coated by decomposition of suitable volatile metal compounds.

Among these, molybdenum oxide ($MoO_3$), tungsten oxide ($WO_3$) and tin oxide ($SnO_2$) and mixtures thereof are particularly preferred, since they permit high positive charge build-ups, as required for most laser printers, also on polyester resin toners which tend to acquire a negative charge and, owing to their good fixing properties, are particularly suitable for high copying speeds.

The thickness of the metal oxide-containing layer is in general from 1 to 500 nm, preferably from 5 to 200 nm, depending on the desired performance characteristics (greater or lesser charge build-up on the toner).

Metals which can be deposited by gas-phase decomposition of corresponding starting compounds are also particularly suitable for the novel metal coating.

Preferred examples are chromium, manganese, cobalt, nickel, zinc, particularly tungsten and iron, and very particularly molybdenum, and mixes thereof.

The thickness of the metal-containing layer is as a rule from 1 to 500 nm, preferably from 2 to 50 nm, depending on the desired conductivity of the carriers.

Instead of the metals, it is of course also possible to apply relatively highly conductive metal oxides, such as magnetite.

For most intended uses, preferred carriers are those in which the metal oxide layer is present as an inner layer and the metal or magnetite layer as an outer layer.

If the coatings are molybdenum and tungsten and their oxides, the converse order of layers is also possible. These carriers can be prepared in a very simple manner by oxidizing the applied metal layer to the desired extent at the surface by controlled heating (as a rule at from 100° to 800° C.) in an oxidizing atmosphere, preferably with oxygen, in particular in the form of air.

In the novel preparation of the coated carriers, the metal oxide layers and the metal layers (with the exception of the abovementioned variant) are applied to the agitated (fluidized) carrier cores by hydrolytic or oxidative or inert decomposition of volatile compounds of the corresponding metals in the gas phase (chemical vapor deposition, CVD).

Suitable starting compounds for this purpose are the metal alcoholates, metal halides, metal carbonyls and metal organyls.

Specific examples of preferred compounds are chromium carbonyls, in particular chromium hexacarbonyl, chromium aryls, such as dibenzenechromium, molybdenumcarbonyls, in particular molybdenum hexacarbonyl, molybdenum aryls, such as dibenzenemolybdenum, tungsten carbonyls, in particular tungsten hexacarbonyl, tungsten aryls, such as dibenzenetungsten, tin halides, in particular tin tetrachloride, especially tin organyls, such as tetrabutyltin, iron carbonyls, in particular iron pentacarbonyl, cobalt carbonyls, in particular dicobalt octacarbonyl, nickel carbonyls, in particular nickel tetracarbonyl, zinc dialkyls, in particular diethylzinc, and manganese carbonyls, in particular dimanganese decacarbonyl.

Other particularly suitable tin compounds are tin organyls which vaporize essentially without decomposition under inert conditions and can be oxidatively decomposed in the gas phase, for example by reaction with oxygen or air or other oxygen/inert gas mixtures, to give tin dioxide, since they permit particularly gentle coating of the carrier cores.

Particularly suitable are compounds of the formula $SnR_4$, where the radicals R are identical or different and are each alkyl, alkenyl or aryl, for example tin tetraalkyls, tin tetraalkenyls and tin tetraaryls, and mixed tin aryl alkyls and tin alkyl alkenyls.

The number of carbon atoms in the alkyl, alkenyl and aryl radicals is in principle not important, but preferred are those compounds which have a sufficiently high vapor pressure at up to about 200° C. in order to ensure simple vaporization.

Accordingly, in the case of tin organyls having 4 identical radicals R, in particular $C_1$–$C_6$-alkyl, especially $C_1$–$C_4$-alkyl, $C_2$–$C_6$-alkenyl, especially allyl, and phenyl are preferred.

Finally, dinuclear or polynuclear tin organyls which may be bridged, for example, via oxygen atoms may also be used.

Examples of suitable organotin compounds are diallyldibutyl tin, tetraamyl tin, tetra-n-propyl tin, bis(tri-n-butyltin) oxide and especially tetra-n-butyl tin and tetramethyl tin.

The decomposition temperatures of the tin organyls are as a rule from 200° to 1000° C., preferably from 300° to 500° C.

The temperature and also the amount of oxygen are advantageously chosen so that the oxidation of the organic radicals to carbon dioxide and water is complete and no carbon is incorporated in the tin dioxide layer. If in fact less oxygen is introduced than is stoichiometrically required, depending on the chosen temperature either the tin organyl undergoes only partial decomposition and then condenses in the waste gas region or formation of carbon black and other decomposition products occurs.

Furthermore, the evaporator gas stream containing the tin organyl should advantageously be set so that the gaseous tin organyl accounts for no more than about 10% by volume of the total amount of gas in the reactor, in order to avoid the formation of finely divided, particulate tin dioxide. Advantageous tin organyl concentrations in the carrier stream itself are usually ≦5% by volume.

The oxidative decomposition of the metal carbonyls to the corresponding metal oxides is preferably also carried out using oxygen or air or other oxygen/inert gas mixtures, reaction temperatures of in general from 100° to 400° C. being suitable. Magnetite-containing layers are as a rule applied decomposition of iron carbonyls in the presence of steam.

The hydrolysis of the metal halides or metal alcoholates with steam to form the metal oxides is usually carried out at from 100° to 600° C., the halides generally requiring the higher temperatures.

The decomposition of the metal carbonyls and metal organyls for the deposition of metal layers is carried out under an inert gas, especially nitrogen. Suitable decomposition temperatures are in general from 100° to 400° C. for the carbonyls and from 150° to 400° C. for the organyls.

In the case of the suitable zinc alkyls of the formula $ZnR_2$, the number of carbon atoms in the alkyl radicals is in principle unimportant, but once again preferred compounds are those which have a sufficiently high vapor pressure at up to 200° C. Accordingly, $C_1$–$C_4$-alkyl radicals are particularly suitable.

The cooling process after coating is complete should also be carried out under inert gas. Nevertheless, passivation of the surface of the metal layer, where a passivation film usually <2 nm thick is formed, generally cannot be ruled out. In the case of an external iron layer, passivation thereof for increasing the stability is even desirable, and air is therefore preferably also blown into the reactor during the cooling.

Suitable reactors for the novel preparation processes are stationary or rotating tubes or agitated mixing units in which an agitated fixed bed or a fluidized bed of the carrier cores to be coated is present. The agitation of the carrier cores can be effected by fluidization with a gas stream, by free-fall mixing, by the action of gravity or with the aid of stirring elements in the reactor.

The procedure is advantageously as follows:

The volatile metal compounds are transferred with the aid of an inert carrier gas stream, for example nitrogen or argon, from an evaporator vessel via a nozzle into the reactor, in which the carrier cores heated to the desired reaction temperature and fluidized with inert gas are present. The metal compound is generally initially taken as a pure substance in the evaporator vessel but may also be initially taken in the form of a solution in an inert, high-boiling (boiling point from about 180° to 200° C.) solvent (eg. 30–50% strength by weight solution of diethyl zinc in petroleum).

If it is intended to deposit a metal oxide layer, the corresponding reaction gas (either oxygen or hydrogen) is preferably introduced via a separate feedline, likewise with the aid of an inert carrier gas, such as nitrogen.

In the preparation of the novel carriers having an inner metal oxide-containing layer and an outer metal-containing layer, the metal deposition may directly follow the metal oxide deposition, it being necessary of course first to shut off the supply of the reaction gas and if necessary to exchange the substance initially taken in the evaporator and to regulate the temperature.

In the preparation of the likewise novel carriers having an inner molybdenum and/or tungsten layer and an outer layer essentially consisting of the oxides of these metals, the oxide layer can likewise be formed directly on the metal deposit with the supply of oxygen/inert gas mixtures, if necessary after regulation of the temperature.

In coating by CVD, the concentration of the vaporized metal compound (and of the reaction gases) in the carrier gas should be preferably ≦5% by volume in order to ensure uniform coating of the carrier. As described above for the tin organyls, the evaporation rates and the reaction temperatures should likewise be chosen so that conversion is as complete as possible and there is no formation of a finely divided metal oxide or metal which would be discharged with the waste gas stream.

The thickness of the layers formed does of course depend on the amount of metal compound fed in and can thus be controlled via the coating time. Both very thin and very thick layers can be applied.

Coating of the carriers by means of gas-phase decomposition of corresponding metal compounds is the preferred procedure for the preparation of the novel carriers. In principle, however, the metal oxide layers can also be applied by precipitation of the metal oxide or metal hydroxide from an aqueous metal salt solution or from an organic solvent and subsequent heat treatment, and the metal layers can be applied by currentless, chemical metal deposition.

The novel carriers have homogeneous, abrasion-resistant metal oxide and metal layers and a surface conductivity in the desired range (from about $10^3$ to $10^8$ ohm resistance). In addition, they have long lives and can therefore generally be used advantageously with the commercial toners for the preparation of electrophotographic two-component developers, the carriers distinguished by high positive toner charges and coated with molybdenum oxide, tungsten oxide and/or tin oxide being particular noteworthy.

EXAMPLES

Preparation and Testing of the Novel Carriers

The novel coating of the carrier cores was carried out in an electrically heated fluidized-bed reactor of 150 mm internal diameter and 130 cm height, having a cyclone and a means for carrier recycling.

In order to investigate the coated carriers, their electrical resistance and the electrostatic chargeability of a toner were determined.

The electrical resistance of the carriers was measured using the C meter from PES Laboratory (Dr. R. Epping, Neufahrn). For this purpose, the carrier particles were agitated for 30 seconds in a magnetic field of 600 Gauss at a voltage $U_0$ of 10 V. The capacitance C was 1 nF as standard, and capacitors having capacitances of 10 or 100 nF were connected in the case of resistances of $<10^7$ ohm.

The resistance R can be calculated from the time-dependent voltage drop after the applied electric field has been switched off, using the formula $$R=t/[C(Ln(U_o/U)]$$

Where:

R is the resistance [ohm], t is the time of the measurement [s],

C is the capacitance [F], $U_o$ is the voltage at the beginning of the measurement [V] and U is the voltage at the end of the measurement [V].

The resistance R is usually expressed in logarithmic values (log R [log ohm]).

To determine the electrostatic chargeability, the carriers were mixed with a polyester resin toner suitable for commercial laser printers (crosslinked fumaric acid/propoxylated bisphenol A resin having a mean particle size of 11 μm and a particle size distribution of from 6 to 17 μm), in each case in a weight ratio of 97:3, and the mixture was activated by thorough mixing in a 30 ml glass vessel for 10 min in a tumbling mixer at 200 rpm.

2.5 g of each of the developers thus prepared were weighed into a hard-blow-off cell (Q/M meter from PES Laboratory, Dr. R. Epping, Neufahrn) which was coupled to an electrometer and into which screens of mesh size 32 μm had been inserted. By blowing off with a vigorous air stream (about 3000 $cm^3$/min) and simultaneous extraction, the toner powder was virtually completely removed whereas the carrier particles were retained in the measuring cell by the screens.

Thereafter, the voltage formed as a result of charge separation was read on the electrometer, and the charge on the carrier (Q=C·U, C=1 nF), which corresponds to the charge on the toner with the opposite sign, was determined therefrom and, by reweighing the measuring cell, was based on the weight of the toner blown off, and the electrostatic charge thereon Q/m [μC/g] was thus determined.

EXAMPLE 1

4 kg of a sponge-like steel carrier having a mean particle size of from 40 to 120 μm (type XCS 40–120 NOD from H öganäs, Sweden) were heated to 350° C. in a fluidized-bed reactor with fluidization with 1 800 l/h of nitrogen.

148 g (100 ml) of tetrabutyl tin were transferred to the reactor in the course of 11 hours with the aid of a nitrogen stream of 400l/h from an upstream evaporator vessel heated to 125° C.

At the same time, 400l/h of air for oxidation were passed into the reactor via the fluidizing gas.

The tin dioxide-coated carrier obtained was then cooled to 200° C. in the reactor while fluidizing with nitrogen.

Thereafter, 30 ml of iron pentacarbonyl were transferred to the reactor in the course of 4 hours with the aid of a nitrogen stream of 100l/h from an evaporator vessel thermostated at 22° C.

After the end of coating with iron, the carrier was cooled to 80° C. with further fluidization. An airstream of 200l/h was then introduced into the reactor for 30 minutes for passivating the iron surface.

After cooling to room temperature, the coated carrier was removed.

The tin content of the carrier was determined as 0.7% by weight by means of atomic absorption spectroscopy.

In the further investigation of the carrier, the following resistance and charge values were determined:

| | log R[log ohm] | Q/m [μC/g] |
|---|---|---|
| Crude carrier/$SnO_2$/Fe | 6.0 | +4.0 |
| Crude carrier/$SnO_2$ (for comparison) | 9.53 | +5.0 |
| Crude carrier (for | <3.0 (outside the | −2.5 |

-continued

| | log R[log ohm] | Q/m [μC/g] |
|---|---|---|
| comparison) | measuring range) | |

EXAMPLE 2

4 kg of an irregularly shaped iron powder having mean particle sizes of from 60 to 150 μm (steel powder from H öganäs, Sweden) were heated to 220° C. in the fluidized-bed reactor while fluidizing with 1 800l/h of nitrogen.

30 g of molybdenum hexacarbonyl were transferred to the reactor in the course of 3 hours with the aid of a nitrogen stream of 400l/h from an evaporator vessel heated to 60° C.

At the same time, 400l/h of air for oxidation were passed into the reactor via the fluidizing gas.

The molybdenum oxide-coated carrier obtained was then additionally coated with metallic molybdenum in the course of 1 hour by feeding in a further 5 g of molybdenum hexacarbonyl in 400l/h of nitrogen from the evaporator vessel, now thermostated at 50° C., and decomposing it under inert conditions at 220° C.

The carrier cooled to room temperature under nitrogen and removed had a molybdenum content of 0.2% by weight (AAS).

Resistance and charge values:

| | log R[log ohm] | Q/m [μC/g] |
|---|---|---|
| Crude carrier/$MoO_3$/Mo | 5.69 | +13.6 |
| Crude carrier/$MoO_3$ (for comparison) | 9.10 | +22.6 |
| Crude carrier (for comparison) | 8.50 | +3.8 |

EXAMPLE 3 a) 3 kg of the crude carrier from Example 2 were heated to 230° C. in a fluidized-bed reactor while fluidizing with 1 800l/h of nitrogen.

75 g of molybdenum hexacarbonyl were transferred to the reactor in the course of 5 hours with the aid of a nitrogen stream of 400l/h from an evaporator vessel heated to 60° C. and were decomposed in the reactor under inert conditions.

The molybdenum-coated carrier obtained was removed after cooling under nitrogen.

b) 500 g of each of the molybdenum-coated carriers were heated for 1 hour in each case at 1) 100° C., 2) 200° C. or 3) 300° C. in a rotary kiln with agitation and with admittance of 100l/h of air.

The carriers $b_1$)–$b_3$) coated with molybdenum and molybdenum oxide and removed after cooling to room temperature had a molybdenum content of 0.7% by weight, as did the carrier a) coated only with molybdenum.

Resistance and charge values:

| | log R[log ohm] | Q/m [μC/g] |
|---|---|---|
| a) Crude carrier/Mo | <3.00 | +24.0 |
| $b_1$) Crude carrier/Mo/$MoO_3$ | 4.73 | +21.1 |
| $b_2$) Crude carrier/Mo/$MoO_3$ | 6.92 | +23.1 |
| $b_3$) Crude carrier/Mo/$MoO_3$ | 9.02 | +30.6 |

-continued

| | log R[log ohm] | Q/m [μC/g] |
|---|---|---|
| Crude carrier | 8.50 | +3.8 |

We claim:

1. A particulate carrier for electrophotography, comprising:

particles of a magnetic material, which form the cores of the carrier particles, each magnetic particle coated with an inner metal oxide layer and an outer metal or magnetite layer or with an inner metal or magnetite layer and an outer metal oxide layer.

2. The carrier as claimed in claim 1, wherein the particles of magnetic material are coated with:

(A) first, a metal oxide-containing layer, and (B) second, a metal- or magnetite-containing layer.

3. The carrier as claimed in claim 1, wherein the metal oxide layer is a layer of molybdenum oxide, tungsten oxide, tin oxide or mixtures thereof.

4. The carrier as claimed in claim 1, wherein the metal layer is a layer of iron, cobalt, nickel, chromium, molybdenum, tungsten, zinc, or manganese.

5. An electrophotographic two-component developer, comprising:

a combination of toner particles with the carrier of claim 1.

6. The carrier as claimed in claim 1, wherein the magnetic cores are coated with an inner, molybdenum- and/or tungsten-containing layer and an outer, molybdenum oxide- and/or tungsten oxide-containing layer.

7. A process for the preparation of an electrophotographic two-component developer, comprising:

combining toner particles with the carrier of claim 6.

8. A process for the preparation of carrier particles, comprising:

agitating particles of a magnetic material; and coating the agitated particles with an inner and outer layer combination of claim 1, whereby said inner or outer metal oxide layer is formed by the hydrolysis of volatile metal alcoholate or metal halide or by the oxidation of a metal carbonyl or metal organyl and the inner or outer metal layer is formed by the inert gas-phase decomposition of metal carbonyl or metal organyl.

9. A process for the preparation of an electrophotographic two-component developer, comprising:

combining toner particles with the carrier of claim 1.

10. A process for the preparation of a carrier, comprising:

agitating particles of a magnetic material;

coating the agitated particles with a first metal layer by the inert gas-phase decomposition of molybdenum carbonyl or aryl and/or tungsten carbonyl or aryl; and heating said metal layer in an oxidizing atmosphere thereby oxidizing the surface region of the metal layer to form a metal oxide layer.

11. A process for the preparation of carrier particles, comprising:

agitating particles of a magnetic material;

coating the agitated particles with molybdenum and/or tungsten by the inert gas phase decomposition of molybdenum carbonyl or aryl and/or tungsten carbonyl or aryl.

* * * * *

UNITED STATES PATENT AND TRADEMARK OFFICE

CERTIFICATE OF CORRECTION

PATENT NO. : 5,614,346

DATED : March 25, 1997

INVENTOR(S) : Jörg ADEL, et al.

It is certified that error appears in the above-indentified patent and that said Letters Patent is hereby corrected as shown below:

On the title page, item [30], the Foreign Application Priority Data should read:

--Feb. 7, 1994 [DE] Germany.....44 03 678.7--

Signed and Sealed this

Twenty-sixth Day of August, 1997

*Attest:*

Bruce Lehman

BRUCE LEHMAN

*Attesting Officer*

*Commissioner of Patents and Trademarks*